United States Patent [19]

Swank

[11] Patent Number: 4,913,501

[45] Date of Patent: Apr. 3, 1990

[54] COMBINATION MULTIPLE-COMPARTMENT STORAGE BIN AND SORTING TRAY

[75] Inventor: Robert P. Swank, Bellville, Ohio

[73] Assignee: Leiter Industries, Inc., Lexington, Ohio

[21] Appl. No.: 332,501

[22] Filed: Mar. 31, 1989

[51] Int. Cl.[4] ..... A47B 29/14

[52] U.S. Cl. ..... 312/211; 211/133; 312/120; 312/123

[58] Field of Search ..... 211/126, 133; 312/120, 312/121, 123, 124, 211

[56] References Cited

U.S. PATENT DOCUMENTS

| | | | |
|---|---|---|---|
| 3,252,614 | 5/1966 | Evans | 211/126 X |
| 4,494,804 | 1/1985 | O'Keefe | 312/211 |
| 4,573,751 | 3/1986 | Swank | 312/211 |
| 4,605,988 | 8/1986 | Nienhuis et al. | 211/126 X |
| 4,615,571 | 10/1986 | Swank | 312/123 X |

*Primary Examiner*—Joseph Falk

*Attorney, Agent, or Firm*—Wood, Herron & Evans

[57] ABSTRACT

A novel combination storage bin and sorting tray comprises a storage bin frame for storing a plurality of article storage containers, and a sorting tray pivotally mounted atop the frame for sorting articles removed from the selected container and for subsequently returning the articles to the selected container upon tipping of the tray relative to the frame.

10 Claims, 1 Drawing Sheet

COMBINATION MULTIPLE-COMPARTMENT STORAGE BIN AND SORTING TRAY

BACKGROUND OF THE INVENTION

The present invention relates to apparatus for sorting a number of articles contained in each of a plurality of storage containers. Specifically, the present invention relates to apparatus for storing a plurality of containers within a storage bin and for facilitating sorting of articles contained within a selected container and for then returning those articles to the container for storage within the storage bin.

A common problem in the storage and sorting of multiple similar articles within a container is one of storing the container and of facilitating sorting of the articles from the container to enable a selected article to be utilized. Typically, numerous similar articles, as for example, nuts or bolts or washers of varying sizes and configurations, are stored within multiple containers. In order to find a selected article within a container, the container having a selected item stored therein is dumped onto a table or workbench, and, after location of the selected article, the unselected articles are scraped off the edge of the workbench into the container. Invariably, some of the unselected articles fall to the floor in the course of trying to return them to the container and are either lost or an inordinate amount of time is lost in returning all of the articles to the container.

DESCRIPTION OF THE PRIOR ART

In order to overcome this sorting problem, it has been proposed in U.S. Pat. No. 4,573,751 to provide a tray pivotally mounted atop a frame, which frame contains a storage bin within which there are a plurality of stored containers. In order to sort articles from a selected container, the container is removable from the storage bin so as to enable the contents of the container to be dumped into the tray. After selection of a selected article from the tray, the container is positioned in a preselected return position of the storage bin beneath an opening in the tray such that when the tray is tipped upwardly, the contents of the tray fall back into the container from which they were removed. A storage bin of this type, though, requires that a selected container be positioned in a preselected return site of the storage bin in order to return the articles to the container. This location of the container at the article return site of the storage bin generally requires repositioning of multiple containers in order to open that return site to an empty container. It has therefore been one objective of this invention to eliminate the need to reposition multiple containers in the storage bin for return of articles from the tray into an empty container.

Still another problem characteristic of the storage bin and tray described in the above-identified patent is the tendency for the hinges of the tray to be broken from the tray if a selected container is filled to overflowing with articles returned to the container or if articles, such as nails, are left protruding from the tray when the contents are dumped from the tray into the container. In that event, return of the tray to the horizontal position from the tipped dumping position can result in an article being pinched between the tray and the storage bin frame and the hinges of the tray being broken.

It has also been proposed to provide a storage bin and sorting tray combination wherein a selected container may be attached to the end of the tray for return of articles to the container after sorting of those articles. Such a tray and storage bin combination is disclosed in U.S. Pat. No. 4,615,571. According to the disclosure of this patent, a selected container is attached to the end of the sorting tray after articles have been dumped from the container into the tray. The articles may then be sorted and pushed into the container during sorting. At the completion of the sorting cycle, the tray may be lifted at the end opposite from the end to which the container is attached so as to dump the contents of the ray into the container. This configuration of tray and attached container has been found in some instances to be limiting in design shape of the container and in the ease of use of the sorting tray during the sorting operation. Accordingly, it has been another objective of this invention to provide a combination multiple-compartment storage bin and sorting tray which is easy to use and which is less restrictive in container design configuration.

SUMMARY OF THE INVENTION

These objectives are achieved in accordance with the practice of this invention by a combination container storage bin and sorting tray wherein the storage bin comprises a frame having vertical ends and a storage bin located between those ends. A plurality of containers are stored within the storage bin. On one end of the storage bin frame there is mounting means for mounting a selected container removed from the storage bin on the frame externally of the storage bin. A tray is mounted atop the frame, which tray has one end pivotally mounted to a first end of the frame and which tray is movable with respect to the frame between a generally horizontal sorting position and an angled discharge position. When the tray is angled, articles contained within the tray are discharged through an open end of the tray into a container mounted to the frame by the container mounting means. After having the contents of a tray dumped into the selected container, the selected container may be returned to the storage bin site from which the container was removed.

These and other objects and advantages of this invention will be more readily apparent from the following description drawings in which.

Figure 1:
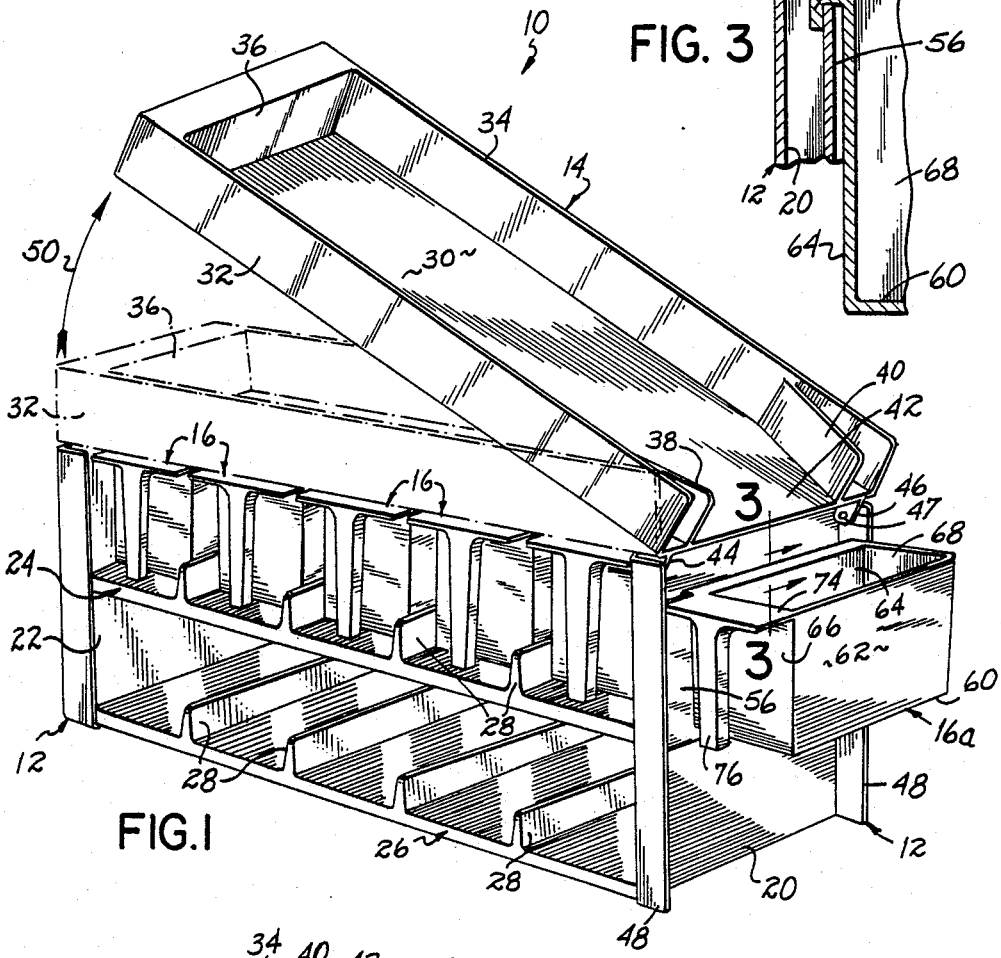
FIG. 1 is a perspective view of a combination storage bin and sorting tray embodying the invention of this a application.

With reference to the drawings, there is illustrated a combination storage bin and sorting tray 10 which comprises the storage bin 12 and sorting tray 14. This storage bin is operative to support and store a plurality of containers 16 within the storage bin.

The storage bin 10 comprises a pair of vertical end walls 20, 22 between which there extend a pair of upper and lower horizontal container supporting walls 24, 26, respectively. Each of these container supporting walls 24, 26 has upstanding from its top surface a plurality of equidistantly spaced divider walls 28. These divider walls 28 are spaced apart a distance slightly greater than the width of the containers 16 and extend vertically approximately one-third the height of the containers from the top surface of the container supporting walls 24, 26.

The tray 14 rests atop the containers 16 which are supported by the upper container supporting wall 24. This tray comprises a bottom wall 30, a pair of sidewalls 32, 34 extending upwardly from the bottom wall 30, and an end wall 36 extending between the sidewalls 32, 34. The end of the tray remote from the end wall 32 is open. At this open end 42 there are a pair of inwardly sloping guide walls 38, 40 which extend inwardly from the sidewalls toward the open end 42 of the tray. These guide walls 38, 40 function as funnels to funnel any articles contained within the tray toward the center of the open end and away from the sidewalls 32, 34 when the contents of the tray are dumped through the open end as explained more fully hereinafter.

The sorting tray 14 is pivotally supported from the end wall 20 of the storage bin frame 12. The pivotal connection of the tray to the frame comprises a pair of ears 44, 46 which extend downwardly from the underside of the bottom wall 30 of the tray. These ears are provided with holes through which pivot pins 47 extend. These pivot pins 47 extend into end flanges 48 of the end wall 20 such that the end of the tray 14 remote from the pivoted end may be lifted upwardly, as indicated by the arrow 50, to angle the tray to a position whereat any articles contained in the tray will fall through the open end 42.

In order to catch any articles which are caused to be dumped from the tray when it is angled upwardly or catch any articles which are pushed through the open end 42 of the tray during sorting of the articles, there is a container mounting means 54 located on the end wall 20. This container mounting means 54 comprises a vertical wall or lip 56 which extends between the two flanges 48 of the end wall and is spaced outwardly from the end wall 20.

Stored within the storage area of the storage bin 12 there are a plurality of identical containers 16. In the illustrated embodiment, there are five such containers 16 which may be supported upon the lower container supporting wall 26 and another five containers 16 which may be supported upon the upper container supporting wall 24. Of course, greater or lesser numbers of containers 16 may be supported and stored within the storage bin area of the frame 12 without departing from the spirit of this invention.

Each of the containers 16 comprises a bottom wall 60 from which there extends upwardly a pair of opposed sidewalls 62, 64 and a pair of opposed end walls 66, 68. These walls all terminate at the upper end in an outwardly extending flange. The outwardly extending flange of one sidewall 64 has a downwardly extending lip 72 which may be hooked over or received over the top edge of the lip 56 of the sidewall 20 of the frame to support the container therefrom. Additionally, a lip 74 of one end wall has a handgrip 76 depending therefrom, which handgrip is spaced from the end wall 66 so as to enable the handgrip to be used as a handle for grasping and moving a container into and out of the storage bin frame 12.

Figure 3:
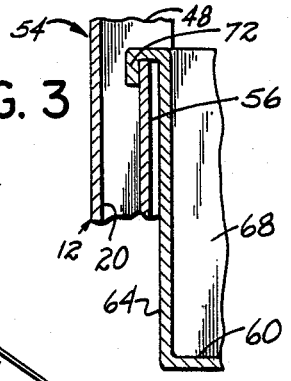
FIG. 3 is a cross-sectional view taken on line 3—3 of FIG. 1.
Figure 2:
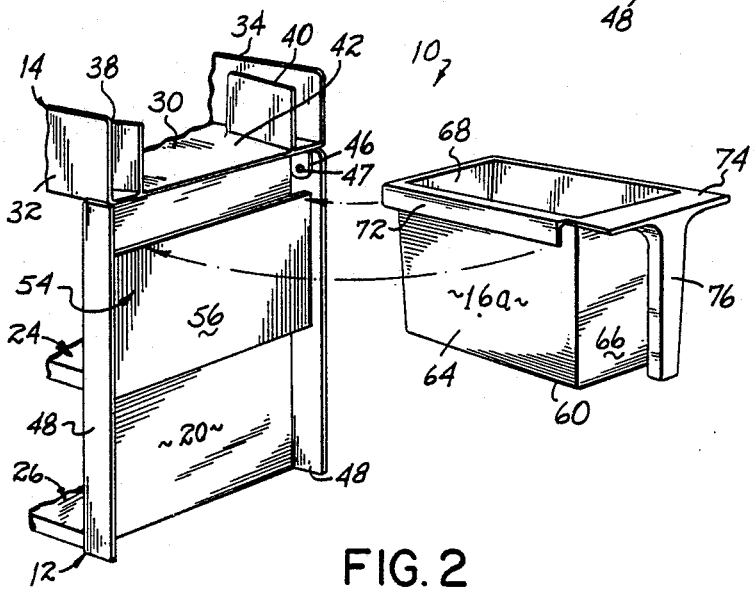
FIG. 2 is a perspective view of one end of the storage bin and tray illustrating the manner of attachment of a selected container to one end of the storage bin frame.

With reference now to FIGS. 2 and 3, it will be seen that in order to support a container from the container mounting means 54, all that is required is to remove a selected container from the storage bin frame 12 and to place the lip 72 of that container over the supporting lip 56 of the frame.

In the use of the combination storage bin and sorting tray 10, articles, such as nuts or bolts or washers or nails, of differing sizes and shapes may be stored in each of the containers 16, and those containers 16 are supported in the storage bin frame 12. Labels identifying the contents of each container may be placed on the face of the containers. When the articles within any container are to be sorted, all that is required is to remove the selected container 16 from the storage bin frame 12 and to dump the contents of that storage bin into the sorting tray 14. The now empty container is then attached or mounted upon the container mounting means 54 by placing the hook-shaped lip 72 of the container over the lip 56 of the container mounting means 54. With the now empty container supported on the end of the frame, articles may be sorted by simply pushing the unselected articles through the open end 42 of the sorting tray from whence they will fall into the open top of the container **16*a* supported on the end of the frame. After a selected article has been identified and removed from the tray, the end of the tray 36 remote from the pivoted open end 42 may be lifted so as to dump any remaining contents in the tray through the funnel-shaped open end 42 of the tray into the open top of the container 16*a*. With the articles having been dumped from the tray, the tray may be lowered into its horizontal attitude illustrated in phantom in FIG. 1. The now filled container 16*a*** may then be returned to an open container receiving site of the storage bin.

The primary advantage of the invention of this application is that it provides a very convenient storage apparatus for storing a multiplicity of different articles in different containers and for enabling the contents of those containers to be easily sorted and then returned to the container from which the articles were removed.

While I have illustrated and described only one preferred embodiment of my invention, persons skilled in this art will appreciate changes and modifications which may be made without departing from the spirit of my invention. Therefore, I do not intend to be limited except by the scope of the following appended claims.

I claim:

1. In combination, a storage apparatus and sorting tray comprising a frame having first and second end walls, said walls having inside surfaces and outside surfaces, a storage bin located between said inside surfaces of said end walls for storing containers within said frame, a plurality of containers stored within said storage bin, mounting means on said external surface of said one end wall for mounting a container removed from said storage bin on said outside surface of said one end wall of said frame externally of said storage bin, a tray having first and second ends, said first end being pivotally mounted to said first end wall of said frame, said tray being adapted to receive articles for sorting, and said tray being movable with respect to said frame between a generally horizontal sorting position and an angled discharge position, said second end of said tray being disposed vertically above said first end of said tray in said angled discharge position of said tray such that articles within said tray are discharged into a selected container mounted to said external surface of said one end wall of said frame by said mounting means upon pivoting of said tray to said angled position, and said selected container having articles from said tray contained therein being thereafter returnable to said storage bin.

2. The combination of claim 1 wherein said first end of said tray is open such that articles may pass through said open end in said angled position of said tray.

3. The combination of claim 2 wherein said tray has vertical front and rear walls and a vertical end wall at said second end of said tray.

4. The combination of claim 3 wherein said front and rear walls funnel inwardly toward one another at said first open end of said tray to provide a funnel-shaped guide for articles passing through said open end of said tray.

5. In combination, a storage apparatus and sorting tray comprising a frame having first and second ends and a storage bin located between said ends for storing containers within said frame, a plurality of containers stored within said storage bin, mounting means for mounting a container removed from said storage bin on said one end of said frame externally of said storage bin, a tray having first and second ends, said first end being pivotally mounted to said first end of said frame, said tray being adapted to receive articles for sorting, said tray being movable with respect to said frame between a generally horizontal sorting position and an angled discharge position, said second end of said tray being disposed vertically above said first end of said tray in said angled discharge position of said tray such that articles within said tray are discharged into a selected container mounted to said frame by said mounting means upon pivoting of said tray to said angled position, and said selected container having articles from said tray contained therein being thereafter returnable to said storage bin, and said container mounting means comprising a vertical lip formed on said one end wall of said frame and means on said containers for receiving said lip.

6. The combination of claim 5 wherein each of said containers has an outwardly and downwardly extending lip on one side of the container, said lips of said containers being engageable with said vertical lip of said frame to support said containers from said frame on said container mounting means.

7. The combination of claim 6 wherein each of said containers has a pair of opposed sidewalls and front and rear end walls extending between said sidewalls of said container, and a handle formed on one of said end walls of said container.

8. The combination of claim 7 wherein each of said handles comprises a handgrip which extends downwardly from an outwardly extending lip on said one end wall of each of said containers.

9. The combination of claim 1 wherein said frame comprises at least one generally horizontal container supporting wall extending between said inside surfaces of said end walls of said frame, and a plurality of equidistantly spaced, parallel divider walls extending upwardly from said container supporting wall.

10. In combination, a storage apparatus and sorting tray comprising a frame having first and second end walls, each of said walls having inside and outside surfaces, a storage bin located between said inside surfaces of said end walls for storing containers within said frame, a plurality of containers stored within said storage bin, mounting means on said external surface of said one end wall for mounting a container removed from said storage bin on said outside surface of said one end wall of said frame externally of said storage bin, an open top tray mounted atop said frame, said tray having a pair of upstanding sidewalls and one end wall, the end of said tray remote from said one end wall of said tray being open, said open end of said tray being pivotally mounted to said first end wall of said frame, said tray being adapted to receive articles for sorting, and said tray being movable with respect to said frame between a generally horizontal sorting position and an angled discharge position, said end of said tray remote from said open end being disposed vertically above said open end of said tray in said angled discharge position of said tray such that articles within said tray are discharged through said open end into a selected container mounted to said frame by said mounting means upon pivoting of said tray to said angled position, and said selected container having articles from said tray contained therein being thereafter returnable to said storage bin.

* * * * *